United States Patent [19]

Hartshorn

[11] Patent Number: 4,467,487

[45] Date of Patent: Aug. 28, 1984

[54] SHOE UPPER CONFORMING MACHINE

[75] Inventor: Frank Hartshorn, Wigston, England

[73] Assignee: USM Corporation, Farmington, Conn.

[21] Appl. No.: 311,483

[22] Filed: Oct. 13, 1981

[30] Foreign Application Priority Data

Oct. 11, 1980 [GB] United Kingdom ..... 8032926

[51] Int. Cl.[3] ..... A43D 21/00

[52] U.S. Cl. ..... 12/8.3

[58] Field of Search ..... 12/12, 8.3, 10

[56] References Cited

U.S. PATENT DOCUMENTS 3,591,878 7/1971 Muhlbach ..... 12/8.3

3,849,818 11/1974 Brailsford et al. ..... 12/8.3

*Primary Examiner*—Patrick D. Lawson

*Attorney, Agent, or Firm*—Donald N. Halgren

[57] ABSTRACT

Shoe upper conforming machine for use in side lasting shoe uppers using lasting rollers which operate progressively along opposite side portions of the shoe has a facility for varying the speed of relative movement between the shoe support and the side lasting instrumentalities. To this end two preset speeds ("slow" and "fast") are available and either the operator can select which speed, using a manually operable switch, or, by selecting an automatic cycle, the speed can be automatically switched during the machine cycle. In particular, it has been found desirable that, with certain styles of shoe the speed of traverse is reduced in the joint region of the shoe bottom. Where adhesive applying nozzles are also provided, if desired the rate of flow of adhesive can be similarly controlled (viz. by selecting from two pre-settings).

16 Claims, 4 Drawing Figures

SHOE UPPER CONFORMING MACHINE

This invention is concerned with shoe upper conforming machines, more especially machines for use in lasting side portions of shoe uppers. The term "shoe" where used herein is used generically as indicating outer footwear generally, and as including an article of outer footwear in the course of its manufacture.

Shoe upper conforming machines for use in lasting side portions of shoe uppers are known comprising a last support on which a last, with a shoe upper thereon and an insole secured to the bottom thereof, can be supported, a support for side lasting instrumentalities, which may comprise two rotary lasting rollers arranged one at either one of the last support and each comprising a wiping surfact disposed helically thereon in such a manner that, as the roller rotates, said wiping surface effects an inwiping action on lasting marginal portions of a shoe upper engaged thereby, and also two adhesive-applying nozzles, one associated with each roller, and means for effecting relative movement, in a direction extending lengthwise of the shoe bottom, between the last support and the support for the side lasting instrumentalities whereby, in the operation of the machine, said instrumentalities are caused to operate progressively along the side portions of the shoe in a direction from the ball region of the shoe bottom to the heel breast line thereof.

In using a machine of the aforementioned type, customarily the speed at which relative movement takes place between the last support and the support for the side lasting instrumentalities is set according to the requirements of the factory in which the machine is installed, and cannot be varied under the control of the operator. Furthermore, since it is necessary for certain styles of shoe that a relatively slow operating speed be set, in order to achieve a satisfactory standard of lasting, either all the shoes which are lasted using the machine are subject to the slow speed, even where a higher speed would be possible without detriment to the lasting quality, thus giving rise to a lower production output than would otherwise be possible, or the speed is set so that certain shoes cannot be satisfactory lasted using the machine, and a second machine has to be provided, whether of the same type or a different one.

In this regard, furthermore, it should be borne in mind that the setting of the speed of such relative movement is regarded as being of such importance as not to be left to the discretion of the operator who, by increasing the speed, may be able to increase his output, but with a consequent detriment to lasting quality.

It is the object of the present invention to provide an improved shoe upper conforming machine for use in lasting side portions of shoe uppers in which the speed at which relative movement is effected between the last support and the side lasting instrumentalities can be varied according to the style of shoe being operated upon, but without leaving the setting of such speed to the discretion of the operator.

The invention thus provides a shoe upper conforming machine for use in lasting side portions of shoe uppers comprising a last support on which a last, with a shoe upper thereon and an insole secured to the bottom thereof, can be supported, a support for side lasting instrumentalities, and drive means for effecting relative movement, in a direction extending lengthwise of the shoe bottom, between the last support and the support for the side lasting instrumentalities whereby, in the operation of the machine, said instrumentalities are caused to operate progessively along the side portions of the shoe in a direction from the ball region of the shoe bottom to the heel breast line thereof, characterised in that the first setting means for controlling the operation of the drive means in such a manner that relative movement is caused to take place between the last support and the support for the side lasting instrumentalities at a first speed, second setting means for controlling the operation of the drive means in such a manner that such relative movement is caused to take place at a second speed, and selector means for selectively rendering operative a selected one of the first and second setting means.

In this way, it will be appreciated, the speed at which the relative movement between the last support and side lasting instrumentalities is effected can be varied, but the limits of such variation are not under the control of the operator, but rather are set by the factory mechanic according to the styles of shoe known to be passing through the factory.

In a first machine in accordance with the invention operator-actuated selector means may be provided for selecting the speed from the pre-settings thereof. Such a provision allows for the lasting of side portions of shoes to be effected at a speed appropriate to the difficulty of attaining a good lasting quality which the shoe in question presents.

Furthermore, it has been found that, in the case of shoes considered to require a slower operating speed, the need for a slower speed arises especially in the joint region of the shoe where, especially in the case of high-heeled shoes, the shoe bottom contour is steeply inclined, so that, at a constant linear speed between the last support and the side lasting instrumentalities, the actual speed of relative movement between the shoe bottom and said instrumentalities is significantly increased, and where, on the inside of the shoe, the side of the last is significantly rounded or inclined towards the last bottom, so that there is a good deal of upper material to be wiped over the insole in order to ensure that the sides of the shoe conform closely to the last shape; this is especially the case where the forepart of the shoe bottom is significantly offset in relation to a longitudinal center line of the shank portion thereof. On the other hand, outside the joint region of the shoe bottom, it has been found that a slower speed is not required, even in the case of shoes having the aforementioned features.

In a second machine in accordance with the invention, therefore, selector means may be provided, conveniently comprising a switch device and an actuator therefor connected one with the last support and the other with the side lasting instrumentalities, which means is operable during relative movement between the last support and the support for the side lasting instrumentalities to cause the speed selected to be switched from one pre-setting to the other. Furthermore, it is usual in a machine of the aforementioned type to provide shoe length measuring means associated with the last support, a grading arrangement also being provided whereby the relative positioning of various switch devices and actuators therefor, for effecting various functions of the machine, can be determined proportionately to the length of the shoe as measured by the shoe length measuring means. In the second machine in accordance with the invention, the shoe length measuring means conveniently serves to determine the relative positioning of the switch device and the actuator therefor of the selector means, and further, since the position of the joint region of the shoe bottom in relation to the side lasting instrumentalities will vary according to the length of the shoe, the grading arrangement is also utilised to determine the initial relative positioning of the switch device and actuator proportionately to the shoe length.

It will thus be appreciated that, for example, the speed at which relative movement is effected between the last support and the side lasting instrumentalities as aforesaid, in the operation of the second machine in accordance with the invention, may be increased from a pre-set "slow" speed to a pre-set "fast" speed after the rollers have been caused to operate in the region of the joint of the shoe bottom.

Furthermore, if desired, at the start of relative movement between the last support and the side lasting instrumentalities, such relative movement may be effected at the "fast" speed and be decreased to the "slow" speed in the region of the joint of the shoe bottom.

For effecting relative movement between the last support and side lasting instrumentalities as aforesaid, whether in the first or second machine in accordance with the invention referred to above, fluid pressure operated drive means may be provided, and the speed of such relative movement may be controlled by a hydraulic arrangement comprising a piston, incorporating a one-way valve, movable along a cylinder having at least two exhaust lines, each line incorporating a settable flow control valve and at least one of said lines also incorporating a valve having a first condition, in which hydraulic fluid can flow therethrough, and a second condition, in which such flow is prevented, the arrangement being such that, by selecting the appropriate condition for the or each such valve, the rate of flow of fluid through the open exhaust line(s), and thus the speed of relative movement between the last support and side lasting instrumentalities, can be controlled.

It has been found that in general two pre-settings of the speed at which relative movement can be effected between the last support and the side lasting instrumentalities as aforesaid is sufficient, and to this end, conveniently the hydraulic arrangement may comprise two such exhaust lines, one of which has a valve of the aforesaid type incorporated therein.

In the first machine referred to above, the selector switch would thus be effective to cause the valve to move between its first and second conditions, while in the second machine the switch device is conveniently effective, when actuated, to cause the valve to move between its first and second conditions, and further the actuator and switch device may be arranged that, as the side lasting instrumentalities are caused to operate over an intermediate part of the side portion of the shoe, the switch device is actuated to cause the valve to be moved from one to the other of its two conditions and then be returned to said one condition.

Furthermore, in said second machine a selector switch may be provided which renders the switch device and its actuator effective or ineffective, under the discretion of the operator.

Where the side lasting instrumentalities comprise two adhesive-applying nozzles, it may well also be advantageous to reduce the speed of relative movement between the last support and the support for the side lasting instrumentalities in the joint region in order to ensure that the nozzles, which may be guided by contact with marginal portions of the insole or shoe upper, adequately follow a path which remains spaced at a constant, or substantially constant, distance from such margin.

Furthermore, in the case, previously referred to, of certain shoe styles, where the speed of relative movement between the nozzles and the shoe bottom is significantly increased as the nozzles track from the joint region down the initial portion of the shank portion of the shoe bottom, the bead of adhesive applied thereby becomes proportionately thinner than is the case where the nozzles are tracking along surfaces parallel, or substantially so, to the linear direction, and although the amount of adhesive applied by the nozzles is not regarded generally as critical, it may be desirable, in certain cases at least, to ensure that an adequate supply of adhesive is provided. To this end the machine is accordance with the invention is preferably provided with means whereby the rate of flow of the adhesive can be varied according to the selected speed at which relative movement is effected as aforesaid between the last support and the support for the side lasting instrumentalities.

Where the adhesive is supplied to the machine in rod form, fluid pressure operated means being provided for supplying such adhesive to melt chambers associated with the nozzles, the feed speed for the adhesive rod may be controlled by a hydraulic arrangement of the same type as is used for controlling the speed of relative movement between the last support and side lasting instrumentalities. Furthermore, the adhesive supply hydraulic arrangement may be controlled by the same selector switch (in the case of the first machine) or switch device and actuator therefor (in the case of the second machine). That is to say, the adhesive supply hydraulic arrangement is operated in parallel with the hydraulic arrangement for controlling the speed of such relative movement.

It will thus be appreciated that the flow control valves can be so set that a first such valve can provide for a "slow" rate of flow of exhaust fluid from said one end of the cylinder, while the two valves in combination provide for a "fast" rate of such flow, the selection of "slow" or "fast" being determined according to whether said selector valve is in its first or second condition.

When such a piston-and-cylinder arrangement is incorporated in a shoe upper conforming machine of the type described above, for controlling the speed of relative movement between the last support and the support for the side lasting instrumentalities, it is envisaged that the mechanic will set the two flow control valves appropriately to the work which is being carried out in the factory, and that the machine operator will be unable to vary such settings. At the same time, the operator can select, in the case of the first machine referred to above, the speed at which such relative movement shall take place, or, in the case of the second machine, whether the speed shall be automatically varied during the course of the operation of the machine.

There now follows a detailed description, to be read with reference to the accompanying drawings, of one machine in accordance with the invention and of a piston-and-cylinder arrangement of the hydraulic checking type in accordance with the invention. It will be appreciated that this machine and this arrangement have been selected for description merely by way of exemplification of the invention and not by way of limitation thereof.

Figure 1:
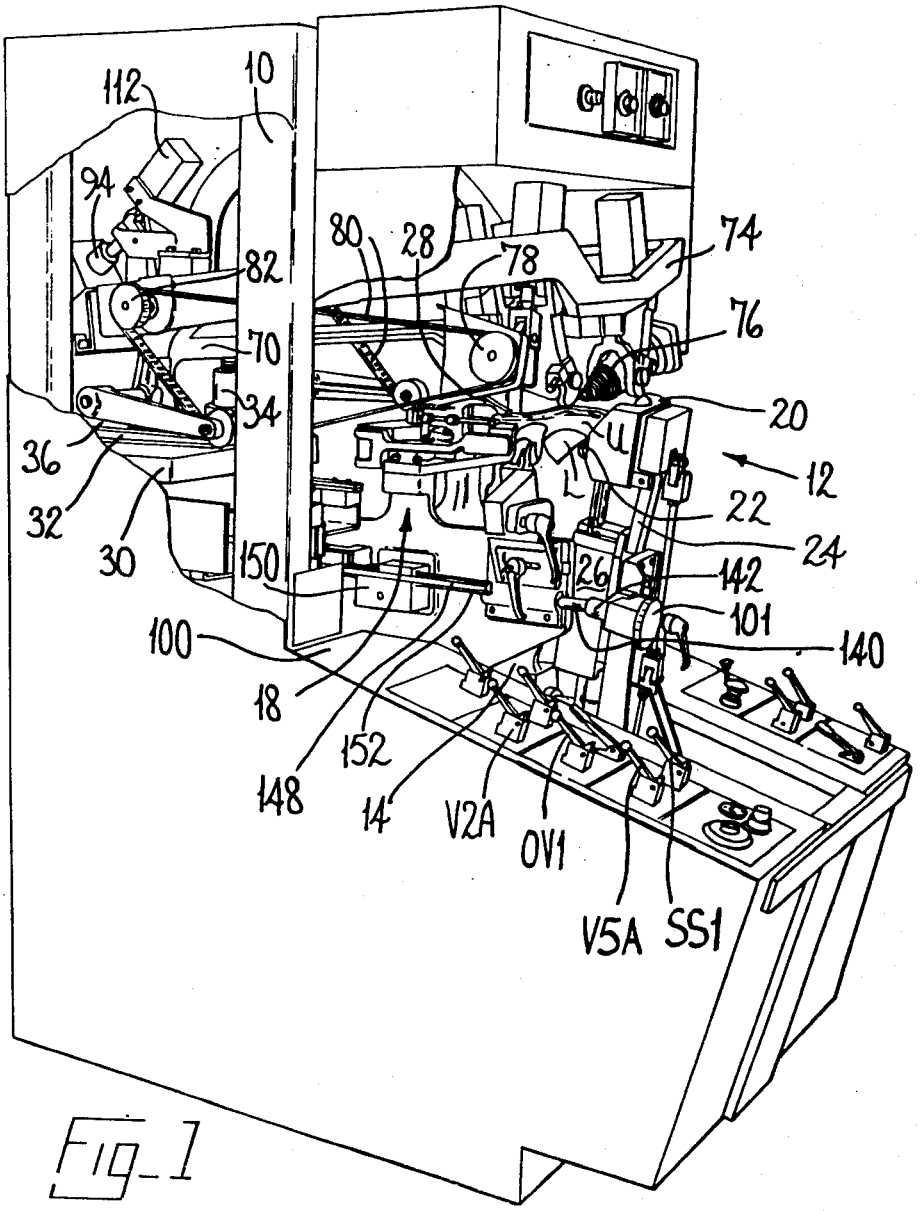
FIG. 1 is a perspective view of the illustrative machine, viewed from the left hand side of the front thereof.
Figure 2:
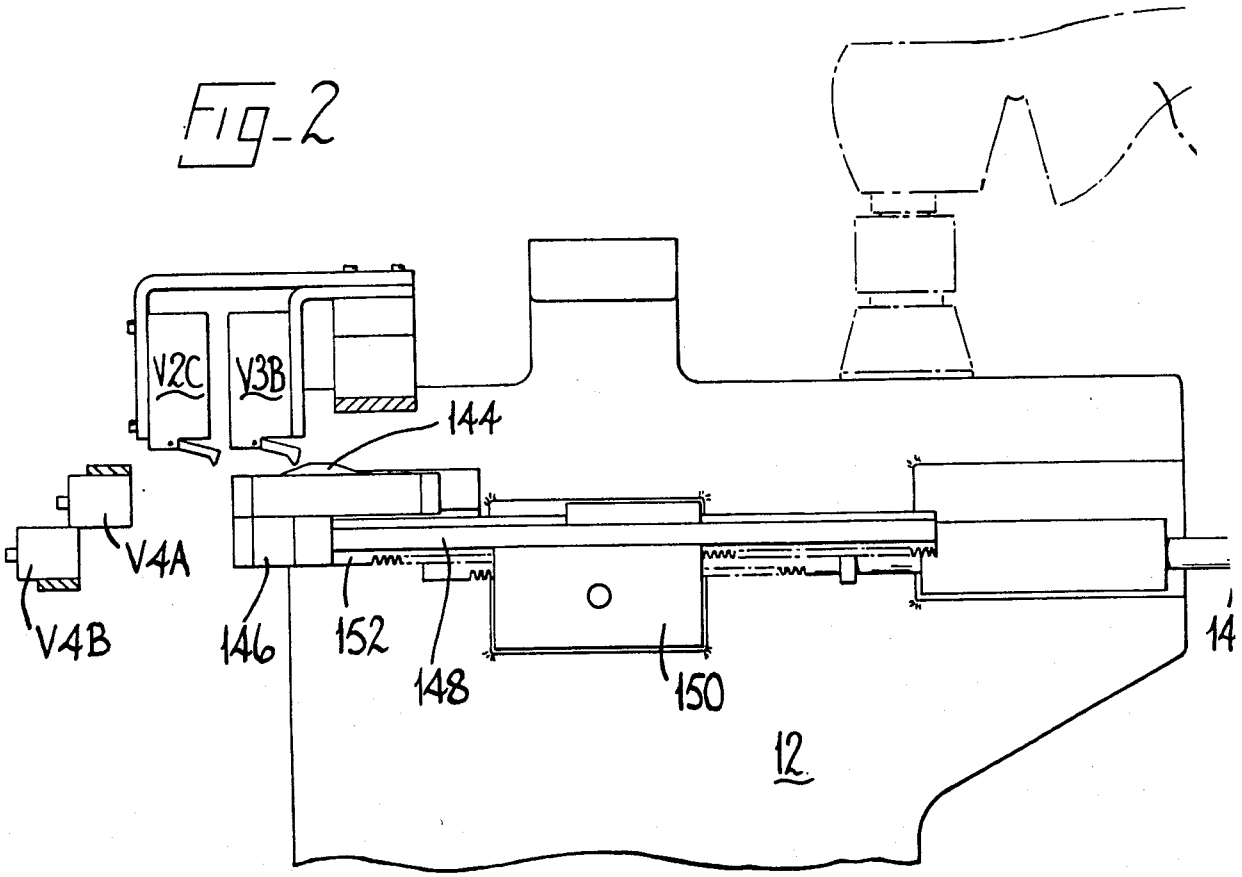
FIG. 2 and 3 are respectively fragmentary plan and side views of the machine, showing details of a switch device and actuator therefor for controlling the speed of relative movement between the last support and side lasting instrumentalities.
Figure 3:
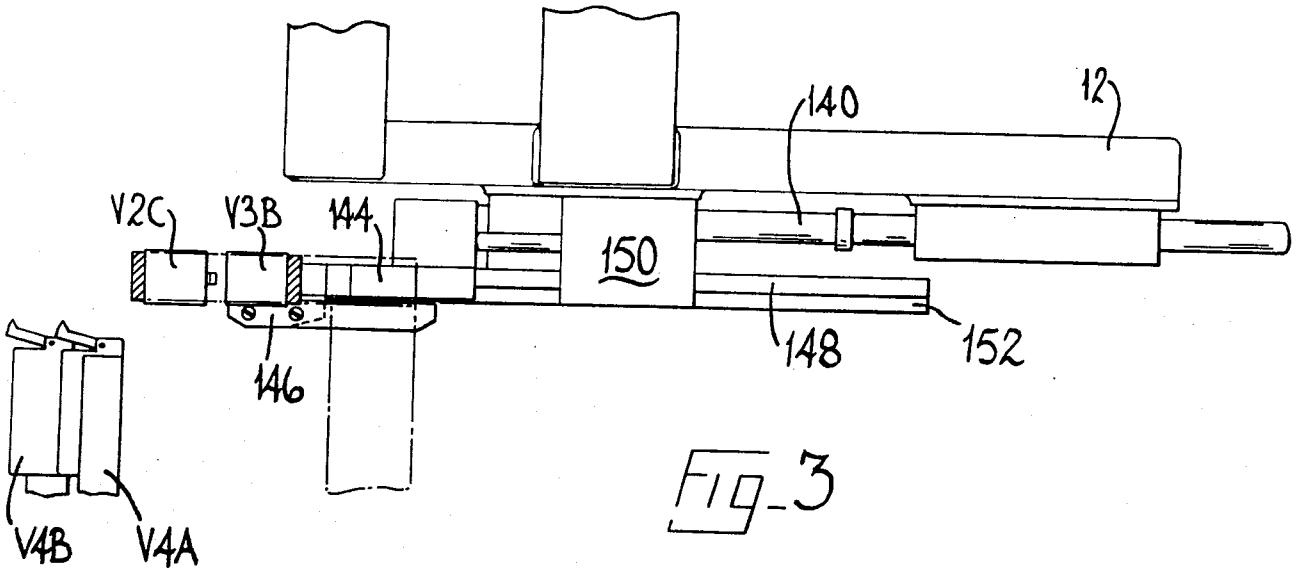

The illustrative machine is a machine for lasting side portions of shoes and is generally similar, except as hereinafter described, to the machine disclosed in U.K. Patent Specification No. 1466266. Thus, the machine comprises a main frame 10 which supports a shoe support arrangement generally designated 12 for movement fore-and-aft of the machine, i.e. in a direction extending lengthwise of the bottom of a shoe supported thereby. The shoe support arrangement comprises a last post 14 having an upstanding last pin (not shown) on which a last L carrying a shoe upper U and insole I can be supported, bottom uppermost, means (not shown) being provided for swinging the last post 14 from a loading position into an operative position in which the heel end of the shoe supported thereby is clamped by a heel and side clamp arrangement generally designated 18. In addition, the shoe support arrangement 12 comprises a toe end engaging member 20 and a toe rest 22, said member and toe rest being carried by a support 24 which is mounted for pivotal movement to bring the member 20, which is generally U-shaped to accommodate the toe end, into engagement with said toe end, the arrangement being such that the member 20 serves to position the shoe in the shoe support arrangement in a desired relationship with the longitudinal center line of the machine. A piston-and-cylinder arrangement 26 is provided for moving the toe rest 22 heightwise, and a holddown member 28 is associated with the heel and side clamp arrangement 18 for determining the heightwise position of the shoe in the shoe support arrangement.

The frame 10 of the illustrative machine includes a base plate 30 to which is secured an auxiliary base plate 32 carrying at its forward end an upstanding pivot post 34 on which a support plate 36 is carried by which various instrumentalities of the illustrative machine are supported, as will be hereinafter described. Fluid pressure operated means (not shown) is provided for effecting pivotal movement of the support plate 36 between first and second operative positions.

Whereas in the machine being described the movement of the support plate 36 is pivotal about the pin 34, in another machine in accordance with the invention and otherwise similar to this machine a support plate may be mounted for sliding movement in a direction extending widthwise of the bottom of a shoe supported by the shoe support arrangement, such sliding movement also being achieved by fluid pressure operated means.

Mounted on the plate 36, at its forward end, is a bridge member 70 on which is pivotally mounted a support frame 74 carrying at its forward end side lasting instrumentalities. Said instrumentalities comprise two lasting rollers 76 which are generally conical, with the apices adjacent one another. Each roller is rotatable about an axis extending widthwise of the bottom of a shoe supported by the shoe support arrangement and each is provided with a wiping element disposed helically about the circumference thereof. For rotating each roller, a drive arrangement is provided including a first pulley 78 operatively connected therewith and connected by a drive belt 80 to a second pulley 82 rotatable about an axis coincident with the axis about which the support frame 74 pivots. The pulley 82 is rotated, through a pulley and belt arrangement (not shown), by an electric motor (not shown) mounted on the support plate 36. For moving the lasting rollers heightwise into and out of engagement with the bottom of a shoe to be operated upon, a piston-and-cylinder arrangement 94 is provided on the support plate 36, for effecting pivotal movement of the support frame 74.

The machine is so arranged that, when the support plate 36 is in its first position, the lasting rollers are positioned symmetrically at opposite sides of the longitudinal centre line of the machine. The support has two second positions, one arranged at either side of the first position, the arrangement being such that when the support plate is in one of its second positions, the instrumentalities are positioned offset from said longitudinal centre line, the selection of which of the second positions being determined according to whether the shoe to be operated upon is a left or a right, means (not shown) being provided, actuated by the toe support 24, for determining which of the two second positions of the support plate 36 is to be selected (the position of said toe support 24 being determined according to whether the shoe supported thereby a left or a right).

The support plate 36 is movable between its first and second positions as aforesaid as the rollers are caused to operate progressively along opposite side portions of the shoe bottom, so that the lasting rollers may be lowered into engagement with the shoe bottom, offset from the longitudinal centre line of the machine, and be returned to a centralised position as they reach the joint region of the shoe bottom. (It will be appreciated that from the joint region of the heel breast line, the path of the rollers can be uniform for left and right shoes, but it is desirable, especially where the forepart portion of the shoe bottom is significantly offset, to lower the rollers in an offset condition in order to cater for the offset shape of shoe bottom.)

For sequencing the movement of the support plate 36 betwen its first and second positions, the fluid pressure operated means for controlling such movement includes a switch device in the form of valves V2C, V3B and actuator means therefor. The actuator means comprises a rod 140, mounted for movement in a direction extending lengthwise of the bottom of a shoe supported by the shoe support arrangement. For moving the rod, an abutment 142 (FIG. 1) is provided, having an adjustment knob 101 associated therewith by means of which the position of the abutment can be varied according to the style of shoe being operated upon), the arrangement being such that, as the support 24 moves to bring the toe end engaging member 22 into engagement with the toe end of the shoe to be operated upon, the abutment 142 engages the end of the rod 140 and moves it into a position determined according to the length of the shoe. Furthermore, the abutment 142 is so positioned on the support 24 that the ratio between the distance from the pivot of said support to the abutment and the distance from said pivot to the shoe toe end engaged by the toe end engaging member 20 is equal, or substantially so, to the ratio between the distance from the heel end of the shoe to the joint region of the bottom of a shoe and the overall length of the shoe, the arrangement thus constituting a grading arrangement. Thus, the movement of the rod 140 varies, between successive shoes to be operated upon, as the heel-end-to-joint-region dimension of the shoe varies.

When the rod 140 has been positioned as aforesaid, it is locked in its adjusted position during subsequent movement of the shoe support arrangement 12 relative to the side lasting instrumentalities. The rod 140 carries a cam member 144 which is arranged to actuate valves V2C, V3B as movement of the shoe support arrangement 12 is effected relative to the side lasting instrumentalities as aforesaid. Since the rod 140 is positioned in relation to the joint region of the shoe being operated upon, it will be appreciated that actuation of the valves by the cam member 144 will be effected in relation to the position of the joint region of such shoe.

The side lasting instrumentalities of the machine also comprise two adhesive-applying nozzles (not shown) each having associated therewith a melt chamber (not shown), to which adhesive can be fed in rod form, the amount of rod adhesive fed and the speed at which it is fed controlling the amount of adhesive applied through the nozzles and the rate of flow of such adhesive therethrough. The nozzles are supported by the support plate 36 in such a manner that, as relative movement is effected between the shoe support arrangement 12 and the side lasting instrumentalities as aforesaid, each nozzle precedes its associated lasting roller 76.

The position of the nozzles in relation to the rollers, prior to initiation of operation of the machine, is so controlled that, if the rollers are lowered into engagement with the shoe bottom in an offset condition, as above described, then the nozzles will also be applied to the shoe bottom in an offset condition. Once the nozzles have been brought thus into contact with the shoe bottom, however, each is capable of pivoting, independently of the other, both heightwise of the shoe bottom (about the axis about which the support frame 74 pivots) and widthwise thereof, the arrangement being such that the nozzles apply adhesive progressively between lasting marginal portions of the upper and corresponding marginal portions of the insole of a shoe supported by the shoe support arrangement 12, as the latter is moved relative to the side lasting instrumentalities as aforesaid.

In the operation of the machine, the nozzles are brought into engagement with the insole of a shoe in advance of the lasting rollers engaging the lasting marginal portions of the shoe upper. To this end, separate piston-and-cylinder arrangements 112 are provided, one associated with each nozzle, for effecting heightwise movement of the nozzles, said arrangements 112 being actuated by valves V4A, V4B which are in turn actuated by means of a cam member 146 mounted on a rod 148 which is supported for movement, in a direction extending lengthwise of the bottom of a shoe being operated upon, by the shoe support arrangement 12. The rod 148 is caused to move as the rod 140 moves, movement of the rod 148, however, being proportionately increased, through a set of gears accommodated in a gear housing 150, the output gear of said set acting on a rack 152 integral with the rod 148, the step-up ratio of the gears being such that the position of the cam member 146 varies with variation in the overall length of successively presented shoes, rather than with variations in the heel-end-to-ball-region dimension thereof. The cam member 146 has two cam faces and is arranged to operate the valves V4A, V4B in sequence. Actuation of valve V4A is effective to arrest the lengthwise movement of the shoe support arrangement in order to allow the nozzles to descend into engagement with the insole, the arrangement being such that the point at which the nozzles engage the insole is at a fixed distance, according to the style, from the toe end of the shoe. Thereafter, the relative movement is caused to continue, when the nozzles have moved outwardly to a position determined by the edge contour of the shoe bottom, to cause the nozzles to track toewardly until again arrested by actuation of valve V4B. In this way, the nozzles are able to move beneath the "scroll" formed during the toe lasting operation, which precedes the side lasting operation, whereafter the direction of relative movement of the shoe support arrangement 12 is reversed to enable the nozzles to track along the sides of the shoe bottom, following the edge bottom contour thereof, and the lasting rollers are caused to descend into engagement with the lasting marginal portions of the upper thus to wipe said portions inwardly over the insole edge and secure them to corresponding marginal portions of the insole.

A machine of the aforementioned type is more specifically described in the specification of our U.K. copending Patent Application 8009771.

Figure 4:
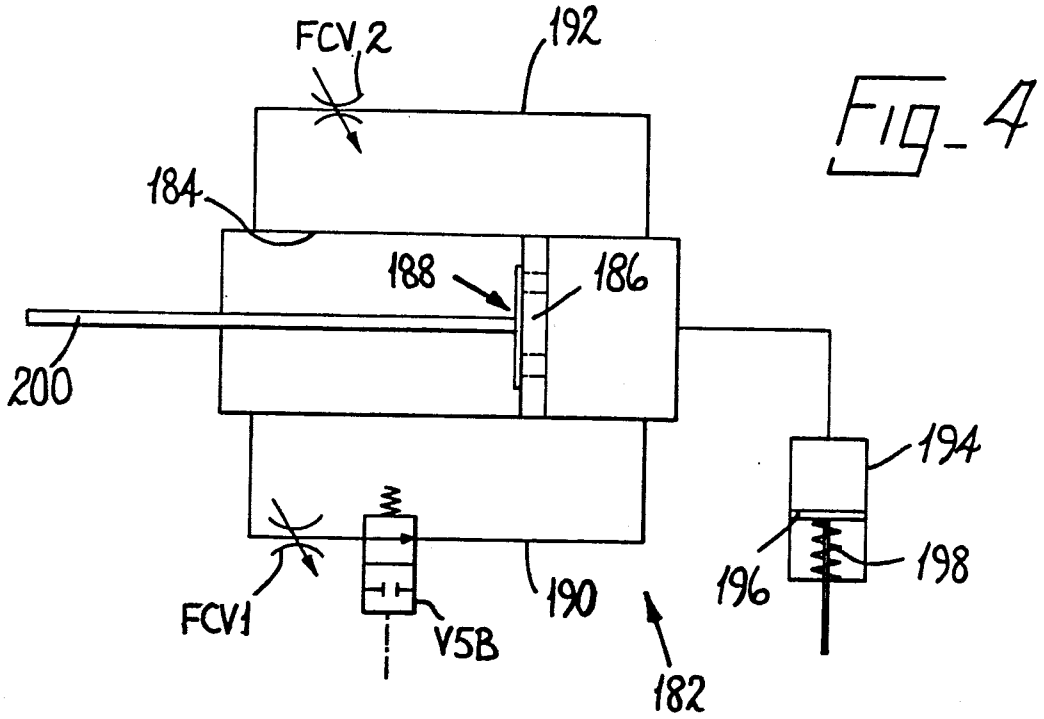
FIG. 4 is a diagrammatic representation of a piston-and-cylinder arrangement of the hydraulic checking type in accordance with the invention.

The machine in accordance with the present invention also comprises speed control means whereby the speed at which relative movement takes place between the shoe support arrangement 12 and the side lasting instrumentalities can be controlled. For effecting such relative movement, the machine comprises fluid pressure operated means, in the form of a pneumatic piston-and-cylinder arrangement (not shown), operatively connected to the shoe support arrangement 12, and also a piston-and-cylinder arrangement of the hydraulic checking type generally designated 182 (see FIG. 4), by which the output speed of the fluid pressure operated means is controlled. More specifically, the arrangement 182 comprises a cylinder 184 along which is slideable a piston 186, incorporating a one-way valve arrangement 188, which is effective to allow movement of the piston 186 along the cylinder 184 in one direction unimpeded while preventing the flow of fluid through said valve arrangement when the piston moves in an opposite direction along said cylinder. Connected between opposite ends of the cylinder 184 are two exhaust lines 190, 192 along which hydraulic fluid can flow when the piston is moved in said opposite direction as aforesaid. Each line has incorporated therein a flow control valve FCV1, FCV2 respectively, each valve being of the needle type, which valves can be set so as to restrict the passage of hydraulic fluid therethrough, and through the lines which incorporate them, as appropriate for a particular side lasting operation of the machine. Furthermore, one (190) of the exhaust lines incorporates a valve V5B having a first condition, in which it allows hydraulic fluid to flow through the line 190 and its incorporated flow control valve FCV1, and a second condition, in which such flow is prevented. In addition, there is connected to the cylinder end into which fluid flows via the exhaust lines 190, 192 a variable capacity reservoir chamber 194, the capacity of which is controlled by a piston 196 on which the fluid in the system acts against the action of a spring 198. Connected to the piston 186 is a piston rod 200 which is connected to the output side of the fluid pressure operated means by which the shoe support arrangement 12 is moved relative to the side lasting instrumentalities. By this connection, the piston-and-cylinder arrangement 182 is used to control the speed at which the shoe support arrangement 12 moves.

It will be appreciated that, according to the condition of valve V5B, either only one flow control valve, namely FCV2, will be effective to control the speed of movement of the shoe support arrangement 12, or both flow control valves may operate together. Thus, valve FCV2 should be set to provide for a "slow" speed, while valve FCV1, which effectively provides an increment to the rate of flow of fluid through FCV2, should be set so that the total flow of fluid through the two valves provides a "fast" speed of movement of the shoe support arrangement 12.

For operating valve V5B, the machine is provided on the control panel 100 with a first selector switch V5A, actuatable by the operator, and effective to switch valve V5B between its two conditions. Conveniently, the control panel 100 will indicate a "slow" and a "fast" setting for the selector switch V5A. In addition, a further selector switch SS1 is also provided on the control panel 100, by means of which selector switch V5A is rendered inoperative and an automatic cycle is selected. In carrying out the automatic cycle, at the start of operation of the machine valve V5B is in its first condition, whereby both flow control valves FCV1, FCV2 are operative and the selected speed is thus "fast". Upon operation of valve V2C, however, in addition to the centralising of the support plate 36, valve V5B is moved to its second condition, thereby rendering flow control valve FCV1 inoperative, and reducing the speed of movement of the shoe support arrangement 12 to "slow". This will of course take place in the region of the joint of the shoe bottom being operated upon. The valve V5B is maintained in its second condition until valve V3B is engaged by the cam 144, the arrangement being such that, upon operation of valve V3B by the cam 144, valve V5B is returned to its first condition, and the speed of movement of the shoe support arrangement 12 is thus restored to "fast". (Valve V3B is also effective to cause the support plate 36 to be moved to a further offset position (see the third operating mode of the machine described in Patent Specification No. 8009771). Whereas, in using said machine, V3B may be rendered ineffective so to move the support plate, in the present machine it remains effective to control the speed of the shoe support arrangement.)

A further selector switch V2A is provided on the control panel 100, whereby valve V2C can be rendered ineffective, so that, at the start of relative movement as aforesaid, the speed of such movement is "slow" up to the joint region.

In using the machine in accordance with the invention hereinbefore described, it is thus possible either to cause the side lasting instrumentalities to operate progressively along the shoe bottom at a reasonably fast speed, or, in the case of difficult uppers, at a slower speed, or again to ensure that the speed over the joint region of the shoe bottom is reduced in relation to the speed over the remainder of the shoe bottom. Nevertheless, whereas the particular mode of operation can be selected by the operator, according to the style of shoe being operated upon, the position within the machine of the flow control valves FCV1, FCV2 can be so arranged as to be inaccessible to the operator, thus leaving the setting of the valves to the mechanic in the factory.

For feeding adhesive rod to the melt chambers, the machine comprises a feed arrangement generally similar, except as hereinafter described, to that described in U.K. Patent Specification No. 1301275, which feed arrangement (not shown) comprises a cylindrical guide tube along which, at diametrically opposed locations, extend a pair of parallel slots into which feed jaws can project, the jaws serving to grip the adhesive rod when moved in one direction, but to slide relative to the rod when moved in an opposite direction, fluid pressure operated means being provided for moving the feed jaws to and fro. The feed movement of the jaws takes place simultaneously with the movement of the shoe support arrangement 12 relative to the side lasting instrumentalities while the latter are in an operative condition. For controlling the rate of feed of adhesive, on the other hand, a piston-and-cylinder arrangement is provided of the hydraulic checking type, said arrangement being of the same construction as the arrangement 184 for controlling the speed at which the shoe support arrangement 12 moves as aforesaid. Thus, the rate of feed of adhesive through the nozzles can be selected, from two pre-settings thereof. Furthermore, the control circuit of the machine is so arranged that the valve V5B and its associated valve in the adhesive supply hydraulic arrangement operate simultaneously, so that the rate of adhesive flow can be selected, from the two pre-settings thereof, either by operation of valve V5A or, by switching valve SS1, automatically during the machine cycle. As already discussed, however, it may be desired to maintain the rate of flow of adhesive constant, especially when operating in automatic mode as above described, over the joint region where the speed of movement of the shoe support arrangement is slowed, and for this purpose an over-ride switch OV1 may be provided on the control panel 100, which switch renders ineffective the circuit portion by which the valve of the adhesive supply hydraulic arrangement can be switched to its second condition during the machine cycle.

Having thus described our invention, what we claim as new and desire to secure as Letters Patent of the United States is:

1. A shoe upper conforming machine for use in lasting side portions of shoe uppers comprising;

a last support on which a last, with a shoe upper thereon and an insole secured in the bottom thereof, can be supported, a support for side lasting instrumentalities, and drive means for effecting relative movement, in a direction extending lengthwise of the shoe bottom, between the last support and the support for the side lasting instrumentalities whereby, in the operation of the machine, said instrumentalities are caused to operate progressively along the side portions of the shoe in a direction from the ball region of the shoe bottom to the heel breast line thereof, characterized by first setting means for controlling the operation of the drive means in such a manner that relative movement is caused to take place between the last support and the support for the side lasting instrumentalities at a first speed;

second setting means for controlling the operation of the drive means in such a manner that such relative movement is caused to take place at a second speed; and selector means for selectively rendering operative a selected one of the first and second setting means.

2. A machine according to claim 1 wherein the selector means is operator-actuatable.

3. A machine according to claim 1 wherein the selector means is operable, during relative movement between the last support and the support for the side lasting instrumentalities to cause the speed selected to be switched from one pre-setting to the other thereof.

4. A machine according to claim 3 wherein the selector means comprises a switch device and an actuator therefor connected one with the last support and the other with the side lasting instrumentalities.

5. A machine according to claim 4 wherein shoe length measuring means is provided associated with the last support, which means serves to determine the relative positioning of the switch device and the actuator therefor prior to initiation of relative movement between the last support and the side lasting instrumentalities as aforesaid.

6. A machine according to claim 5 wherein a grading arrangement is provided whereby the relative positioning of the switch device and the actuator therefor is determined proportionately to the length of the shoe as measured by the shoe length measuring means.

7. A machine according to claim 1 wherein the drive means is fluid pressure operated means, the speed of the relative movement between the last support and side lasting instrumentalities being controlled by a hydraulic arrangement comprising a piston, incorporating a one-way valve, movable along a cylinder having two exhaust lines, one of which incorporates the first setting means, constituted by a first settable flow control valve, and the other the second setting means, constituted by a second settable flow control valve, and one of said lines also incorporating a valve having a first condition, in which hydraulic fluid can flow therethrough, and a second condition, in which such flow is prevented, the arrangement being such that, by selecting the appropriate condition for the valve, the rate of flow of fluid through the open exhaust line(s), and thus the speed of relative movement between the last support and side lasting instrumentalities, can be controlled.

8. A machine according to claim 7 wherein the selector means comprises an operator-actuated selector switch effective to cause the valve to move between its first and second conditions.

9. A machine according to claim 7 wherein speed control means is operable during the relative movement between the last support and the support for the side lasting instrumentalities, to cause the speed selected to be switched from one pre-setting to the other, said means comprising a switch device effective, when actuated by an actuator member, to cause the valve to move between its first and second conditions, the actuator and switch device being so arranged that, as said side lasting intrumentalities are caused to operate over an intermediate part of the side portion of the shoe, the switch device is actuated to cause the valve to be moved from one to the other of its two conditions and then be returned to said one condition.

10. A shoe upper conforming machine for use in lasting side portions of shoe uppers comprising a last support on which a last, with a shoe upper thereon and an insole secured to the bottom thereof, can be supported, side lasting instrumentalities, comprising two rotary lasting rollers, arranged one at either one of the last support and each comprising a wiping surface disposed helically thereon in such a manner that, as the roller rotates, said wiping surface effects an inwiping action on lasting marginal portions of a shoe upper engaged thereby, and means for effecting relative movement, in a direction extending lengthwise of the shoe bottom, between the last support and the side lasting instrumentalities whereby, in the operation of the machine, the rollers are caused to operate progressively along the side portions of the shoe in a direction from the ball region of the shoe bottom to the heel breast line thereof, wherein the speed at which relative movement is effected between the last support and the side lasting instrumentalities as aforesaid is increased from a pre-set "slow" speed to a pre-set "fast" speed after the rollers have been caused to operate in the region of the joint of the shoe bottom.

11. A machine according to claim 10 wherein, at the start of relative movement between the last support and the side lasting instrumentalities, such relative movement is effected at the "fast" speed and is decreased to the "slow" speed in the region of the joint of the shoe bottom.

12. A machine according to claim 10 wherein the side lasting instrumentalities also comprise two adhesive-applying nozzles, one associated with each lasting roller, each nozzle being so arranged in relation to its associated roller that, when relative movement is effected as aforesaid, it precedes said roller thus to apply a bead of adhesive to the side portion of the shoe, between the lasting marginal portion of the upper and corresponding marginal portion of the insole, in advance of the operation as aforesaid of the roller, and further wherein means is provided whereby the rate of flow of adhesive can be varied according to the selected speed at which relative movement is effected as aforesaid.

13. A machine according to claim 12 wherein fluid pressure operated means is provided for supplying adhesive in rod from to melt chambers associated with the nozzles, the feed speed for such adhesive being controlled by a hydraulic arrangement comprising a piston, incorporating a one-way valve, movable along a cylinder having two exhaust lines, each line incorporating a settable flow control valve and one of said lines also incorporating a valve having a first condition, in which hydraulic fluid can flow therethrough, and a second condition, in which such flow is prevented, the arrangement being such that, by selecting the appropriate condition for the valve, the rate of flow of fluid through the open exhaust line(s), and thus the feed speed for the adhesive rod, can be controlled.

14. A machine according to claim 13 wherein an operator-actuated selector switch is provided, effective to cause the valve of the adhesive supply hydraulic arrangement to move between its first and second conditions.

15. A machine according to claim 13 wherein speed control means is provided, operable during the relative movement between the last support and the support for the side lasting instrumentalities to cause the adhesive feed speed to be switched from one pre-setting to the other, said means comprising a switch device effective, when actuated by an actuator therefor, to cause the valve of the adhesive supply hydraulic arrangement to move between its first and second conditions as aforesaid.

16. A piston-and-cylinder arrangement of the hydraulic checking type, the piston of which incorporates a one-way valve and has a piston rod connected thereto, and the cylinder of which has two exhaust lines for the passage of hydraulic fluid from the cylinder as the piston is moved along said cylinder in a direction such as to cause the one-way valve of the piston to be closed, the hydraulic fluid when exhausted passing to an opposite end of the cylinder, and the arrangement also comprising a variable capacity reservoir chamber connected to said opposite end of the cylinder for maintaining the latter full of fluid during the movement of the piston, and one of said lines also incorporating a selector valve having a first condition, in which hydraulic fluid can flow therethrough and through the exhaust line in which it is incorporated, and a second condition, in which such flow is prevented, wherein such exhaust line incorporates a flow control valve, adjustment of which varies the rate at which exhausting hydraulic fluid can flow therethrough.

* * * * *